US009824809B2

(12) United States Patent
May

(10) Patent No.: US 9,824,809 B2
(45) Date of Patent: Nov. 21, 2017

(54) MODULAR TRANSFORMER SYSTEM

(71) Applicant: TSTM, Inc., Sioux Falls, SD (US)

(72) Inventor: Greg May, Sioux Falls, SD (US)

(73) Assignee: TSTM, Inc., Sioux Falls, SD (US)

( * ) Notice: Subject to any disclaimer, the term of this patent is extended or adjusted under 35 U.S.C. 154(b) by 144 days.

(21) Appl. No.: 14/680,727

(22) Filed: Apr. 7, 2015

(65) Prior Publication Data

US 2016/0012953 A1 Jan. 14, 2016

Related U.S. Application Data

(60) Provisional application No. 61/976,387, filed on Apr. 7, 2014.

(51) Int. Cl.

| | |
|---|---|
| ***H01F 27/02*** | (2006.01) |
| ***H01F 27/04*** | (2006.01) |
| ***H01F 5/00*** | (2006.01) |
| ***H01F 27/28*** | (2006.01) |

(52) U.S. Cl.
CPC ..... *H01F 27/027* (2013.01)

(58) Field of Classification Search
CPC ..... H01F 27/06; H01F 41/02
USPC ..... 336/90, 92, 96, 107, 200, 232
See application file for complete search history.

(56) References Cited

U.S. PATENT DOCUMENTS

| | | | | |
|---|---|---|---|---|
| 4,533,786 | A * | 8/1985 | Borgmeyer | H05K 5/0004 174/50 |
| 4,737,903 | A | 4/1988 | Nishikawa et al. | |
| 5,087,875 | A | 2/1992 | Balch et al. | |
| 6,112,158 | A | 8/2000 | Bond et al. | |
| 6,239,962 | B1 * | 5/2001 | Seymour | H01H 71/1018 361/115 |
| 6,242,993 | B1 * | 6/2001 | Fleege | G01R 31/025 335/18 |
| 6,289,267 | B1 | 9/2001 | Alexander et al. | |
| 6,538,577 | B1 | 3/2003 | Ehrke et al. | |
| 6,998,043 | B2 | 2/2006 | Fischer et al. | |
| 7,064,679 | B2 | 6/2006 | Ehrke et al. | |
| 7,277,027 | B2 | 10/2007 | Ehrke et al. | |
| 7,359,221 | B2 | 4/2008 | Knill | |

(Continued)

FOREIGN PATENT DOCUMENTS

| | | |
|---|---|---|
| WO | WO 87/07105 A1 | 11/1987 |
| WO | WO 2010/130258 A1 | 11/2010 |

*Primary Examiner* — Tsz Chan
(74) *Attorney, Agent, or Firm* — Merchant & Gould P.C.

(57) ABSTRACT

A transformer system includes a transformer module and a base module. One or more transformer modules are detachably coupled to the base module. The transformer module includes a housing, a transformer, primary-side and secondary-side wires electrically connected to primary and secondary terminals of the transformer, a conductive tab electrically connected to a neutral terminal of the transformer, and a first coupling mechanism. The base module includes a base enclosure, a neutral connector electrically connected to a power line neutral connection, and a second coupling mechanism. The second coupling mechanism detachably engages the first coupling mechanism of the transformer module, and the conductive tab of the transformer module is electrically connected to the neutral connector of the base module when the first coupling mechanism is engaged with the second coupling mechanism.

14 Claims, 7 Drawing Sheets

(56) References Cited

U.S. PATENT DOCUMENTS

| | | | | |
|---|---|---|---|---|
| 7,583,202 | B2 | 9/2009 | Robinson et al. | |
| 7,772,989 | B2 | 8/2010 | Ehrke et al. | |
| 7,986,202 | B2 * | 7/2011 | Woodson | H01H 83/144 335/18 |
| 8,023,235 | B2 | 9/2011 | Bilac et al. | |
| 8,537,028 | B2 | 9/2013 | Ehrke et al. | |
| 2002/0128035 | A1 | 9/2002 | Jokinen et al. | |
| 2009/0059638 | A1 * | 3/2009 | Homyk | H02M 5/14 363/154 |
| 2009/0189723 | A1 * | 7/2009 | Irgens | H01F 27/22 336/55 |
| 2009/0273425 | A1 * | 11/2009 | Tremaine | H01F 27/02 336/90 |
| 2010/0148901 | A1 * | 6/2010 | Powell | H01F 27/06 336/65 |
| 2010/0318306 | A1 | 12/2010 | Tierney et al. | |
| 2012/0026007 | A1 | 2/2012 | Beattie | |
| 2012/0126814 | A1 * | 5/2012 | Fischer | G01R 33/30 324/318 |
| 2012/0264385 | A1 | 10/2012 | Oh et al. | |
| 2015/0285844 | A1 | 10/2015 | May | |
| 2015/0288175 | A1 | 10/2015 | May | |

* cited by examiner

MODULAR TRANSFORMER SYSTEM

CROSS-REFERENCE TO RELATED APPLICATIONS

The present disclosure claims priority from U.S. Provisional Application No. 61/976,387, filed on Apr. 7, 2014, the disclosure of which is hereby incorporated by reference in its entirety.

TECHNICAL FIELD

The present disclosure relates generally to a transformer system, and in particular a modular transformer system, such as may be useable in electrical metering and distribution systems.

BACKGROUND

In an electrical power system, electrical transformers are often used to connect two different voltage systems or buses in an electrical substation. An electrical transformer is an electromagnetic device that transfers electrical energy from one circuit to another through mutual inductance. During this energy transfer, electricity may be converted from one voltage level or type to another. The transformer typically includes two windings, the primary winding connected to the source of voltage and the secondary winding connected to the load. The windings are wound around a silicon steel laminated core which provides a path for the flow of magnetic flux to achieve the transfer of energy from the primary to the secondary winding. On the other hand, an autotransformer has only one winding, portions of which act as both the primary and secondary sides of the transformer. The autotransformer has typically three taps where electrical connections are made, such as a primary tab, a secondary tab, and a neutral tab. Autotransformers can be configured to be smaller, lighter, and cheaper than typical dual-winding transformers.

In traditional metering applications, isolation transformers are typically used due to their robustness, and due to the requirement of high thermal burden and accuracy, and because such transformers are used in connection with both metering and power supply portions of an electrical meter. However, such isolation transformers are heavy, expensive, and difficult to maintain (add, remove, or replace) by service technicians. Even if other types of transformers are used, there is no convenient way to connect or disconnect such transformers from a system, in particular systems in which such transformers are added into an existing circuit.

For these and other reasons, improvements are desirable.

SUMMARY

In summary, the present disclosure relates to a transformer system. In one possible configuration and non-limiting example, the transformer system includes one or more transformer modules.

In a first aspect, a transformer system includes a transformer module and a base module. The transformer module includes a housing frame; a transformer mounted to the housing and having a primary terminal, a secondary terminal, and a neutral terminal; a primary-side wire electrically connected to the primary terminal of the transformer and extending from the housing frame to be connected to a line power; a secondary-side wire electrically connected to the secondary terminal of the transformer and extending from the housing frame to be connected to a load; a conductive tab electrically connected to the neutral terminal of the transformer and extending from the housing frame; and a first coupling mechanism. The base module includes a base enclosure; a neutral connector configured to be electrically connected to a power line neutral; and a second coupling mechanism arranged on the base enclosure and configured to detachably engage the first coupling mechanism of the transformer module. The conductive tab of the transformer module may be electrically connected to the neutral connector of the base module when the first coupling mechanism is engaged with the second coupling mechanism.

The transformer system may further include a second transformer module. The second transformer module includes a housing frame; a transformer located outside the housing and having a primary terminal, a secondary terminal, and a neutral terminal; a primary-side wire electrically connected to the primary terminal of the transformer and extending from the housing frame to be connected to a line power; a secondary-side wire electrically connected to the secondary terminal of the transformer and extending from the housing frame to be connected to a load; a conductive tab electrically connected to the neutral terminal of the transformer and extending from the housing frame; and a first coupling mechanism. The conductive tab of the second transformer module may be electrically connected to the neutral connector of the base module when the first coupling mechanism of the second transformer module is engaged with the second coupling mechanism.

In a second aspect, a transformer module includes a housing frame; a transformer having a primary terminal, a secondary terminal, and a neutral terminal; a primary-side wire electrically connected to the primary terminal and extending from the housing frame to be connected to a line power; a secondary-side wire electrically connected to the secondary terminal and extending from the housing frame to be connected to a load; a conductive tab electrically connected to the neutral terminal and extending from the housing frame; and a coupling mechanism configured to be detachably engaged with a base module, the base module having a neutral connector configured to be electrically connected to a power line neutral. The conductive tab may be electrically connected to the neutral connector when the coupling mechanism is engaged with the base module. In some examples, the transformer is mounted to the housing frame. In other examples, the transformer is arranged remotely from the housing frame.

In a third aspect, a method of transferring energy between two circuits through electromagnetic induction includes: mounting a transformer within a housing; connecting a primary-side wire to a primary terminal of the transformer such that the primary-side wire extends from the housing; connecting a secondary-side wire to a secondary terminal of the transformer such that the secondary-side wire extends from the housing; connecting a conductive tab to a neutral terminal of the transformer such that the conductive tab extends from the housing; and coupling the housing to a base module such that the conductive tab is electrically connected to a neutral connector of the base module, the neutral connector electrically connected to a power line neutral.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

Generally speaking, the present disclosure relates to a transformer system, and in particular improvements to such a transformer system that includes one or more transformer modules. The one or more transformer modules can selectively or individually add transformers to circuitry, thereby allowing the transformer system to be detachably arranged and easily modifiable in the circuitry.

Figure 1:
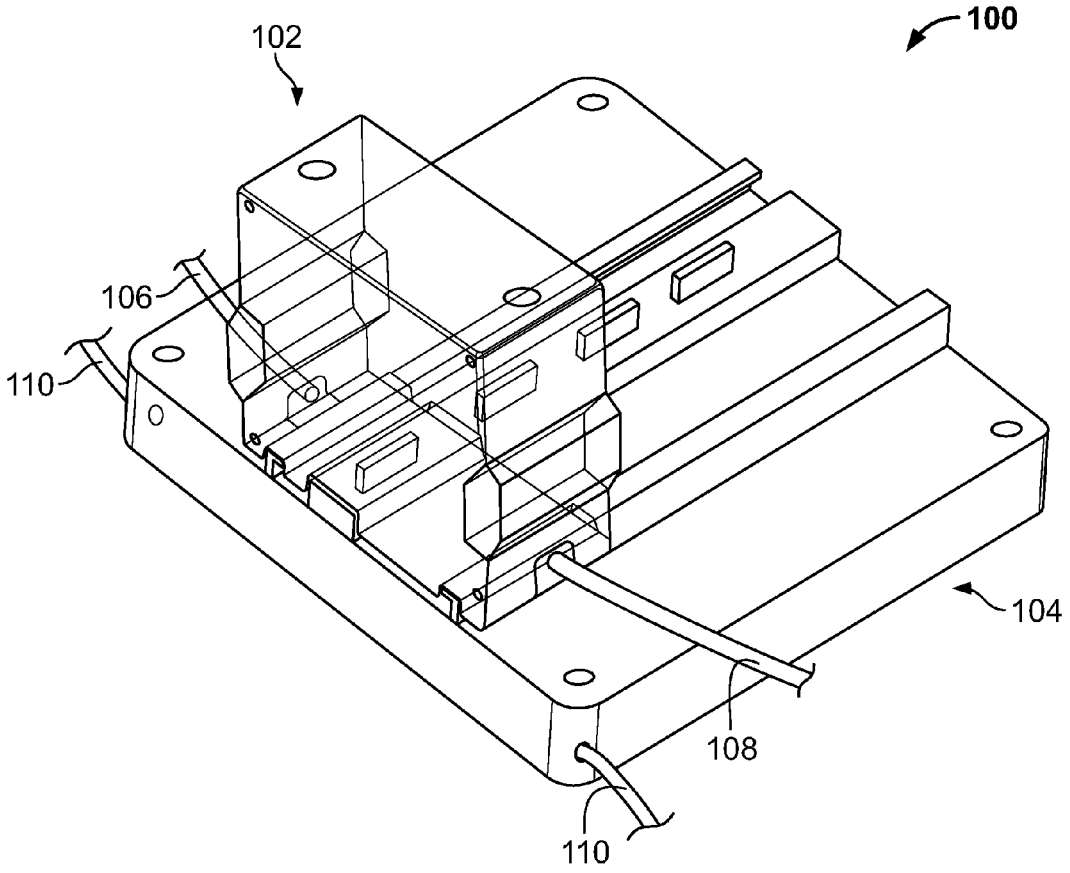
FIG. 1 illustrates an exemplary transformer system implementing aspects of the present disclosure.

FIG. 1 illustrates an exemplary transformer system 100 implementing aspects of the present disclosure. The transformer system 100 includes a transformer module 102 and a base module 104.

The transformer module 102 operates as a transformer. In the depicted example, the transformer module 102 is configured to implement a toroidal autotransformer, which has only one winding. Although the transformer system 100 is described primarily with an autotransformer, the concepts and principles of the present disclosure are similarly applicable to a transformer system having any type of transformers sized to fit within the modular systems discussed herein.

The transformer module 102 includes a primary-side wire 106 and a secondary-side wire 108. The primary-side wire 106 is configured to connect a primary side of the transformer module 102 to an input electric power supply. Examples of the input electric power supply include an AC line power or AC mains. The secondary-side wire 108 is configured to connect a secondary side of the transformer module 102 to a load. The transformer module 102 is described below in further detail with reference to FIGS. 3 and 4.

Figure 2:
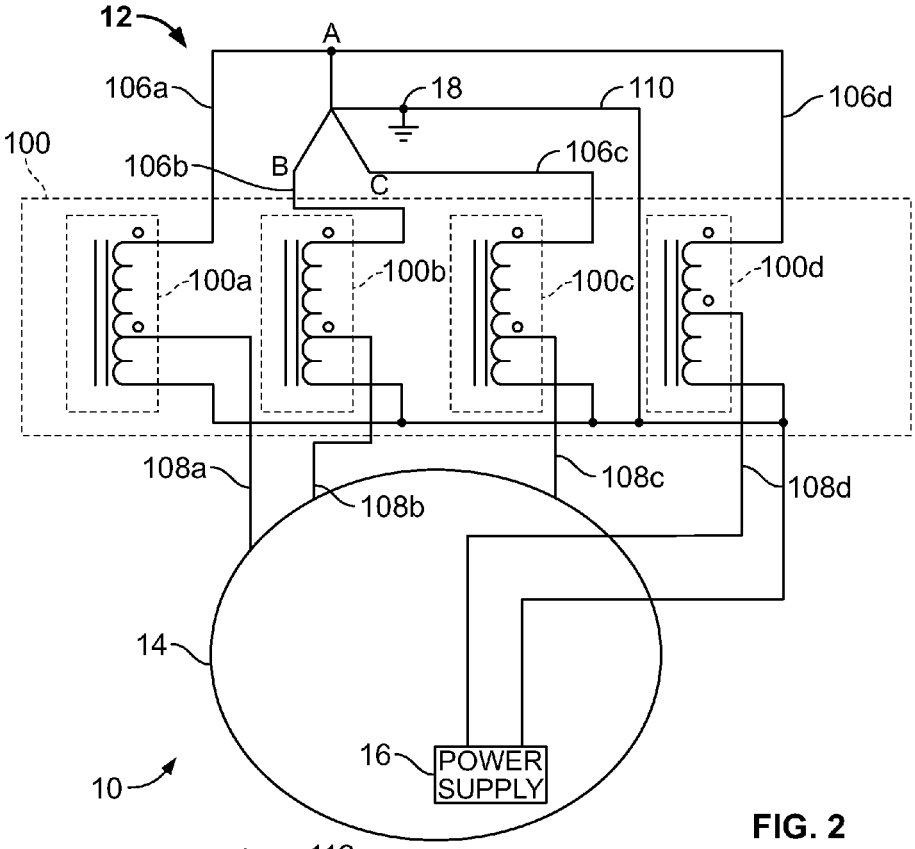
FIG. 2 is a schematic layout of exemplary circuitry that uses the transformer system of FIG. 1.

The base module 104 operates to accommodate one or more transformer modules 102 and electrically connect a common terminal of the autotransformer incorporated in the transformer module 102 to a power line neutral connection 18 (FIG. 2). In this document, the common terminal is also referred to as a neutral terminal The base module 104 includes a neutral connection wire 110 configured to connect the common terminal or neutral terminal of the transformer module 102 to the power line neutral connection 18. In the depicted examples, the base module 104 is configured to engage up to four transformer modules 102. The multiple transformer modules 102 can be selectively or individually coupled to the base module 104 and easily mounted onto or detached from the base module 104. The base module 104 is described below in further detail with reference to FIGS. 5-7.

FIG. 2 is a schematic layout of exemplary circuitry 10 that uses the transformer system 100 of FIG. 1. In particular, the circuitry 10 implements a transformer-rated metering arrangement with a 4-wire wye connection 12. The circuitry 10 includes an electrical meter 14. The meter 14 includes a power supply 16 configured to provide power to components of the meter 14. In the depicted example, the transformer system 100 includes three voltage transformer systems 100*a*, 100*b* and 100*c* and a signal transformer system 100*d*. The transformer modules 102, as described above and will be described below in more detail, are employed for the voltage transformer systems 100*a*, 100*b* and 100*c* and the signal transformer system 100*d* in the same or similar manner.

The transformer system 100 (including 100*a*, 100*b*, 100*c* and 100*d*) is electrically connected to a three-phase power supply 12. For example, the primary-side wires 106*a*, 106*b* and 106*c* of the transformer modules 102*a*, 102*b* and 102*c* (e.g., the transformer modules for the voltage transformer systems 100*a*, 100*b* and 100*c*) are electrically connected to terminals A, B and C of the three-phase power supply 12, respectively. The secondary-side wires 108*a*, 108*b* and 108*c* of the transformer modules 102*a*, 102*b* and 102*c* are electrically connected to the meter 14. Similarly, the primary-side wire 106*d* of the transformer module 102*d* (e.g., the transformer module for the signal transformer system 100*d*) is electrically connected to the terminal A of the power supply 12. The secondary-side wire 108*d* of the transformer module 102*d* is electrically connected to the meter 14. The neutral connection wire 110 of the base module 104 is electrically connected to the power line neutral connection 18.

Although the transformer system 100 is described primarily with a 4-wire wye connection as shown in FIG. 2, the transformer system 100 can be used with other types of arrangements, such as 3-wire delta service, or in any other system implementing a transformer-rated meter. The transformer system 100 can also be used with an electrical metering circuit. Examples of such a metering circuit are discussed in further detail in connection with U.S. patent application Ser. No. 14/246,990, entitled "TRANSFORMER-RATED ELECTRICAL METER ARRANGEMENT WITH ISOLATED ELECTRICAL METER POWER SUPPLY," and filed on Apr. 7, 2013, the disclosure of which is hereby incorporated by reference in its entirety. The transformer system 100 can also be used with two-phase power supplies or single-phase power supplies.

Figure 3:
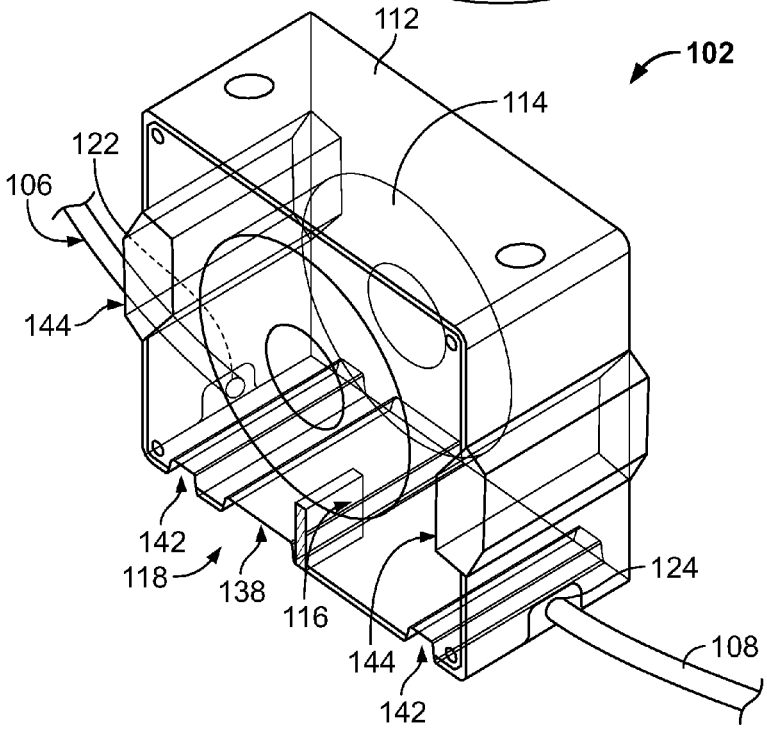
FIG. 3 is a schematic perspective view of a transformer module according to one example of the present disclosure.
Figure 4:
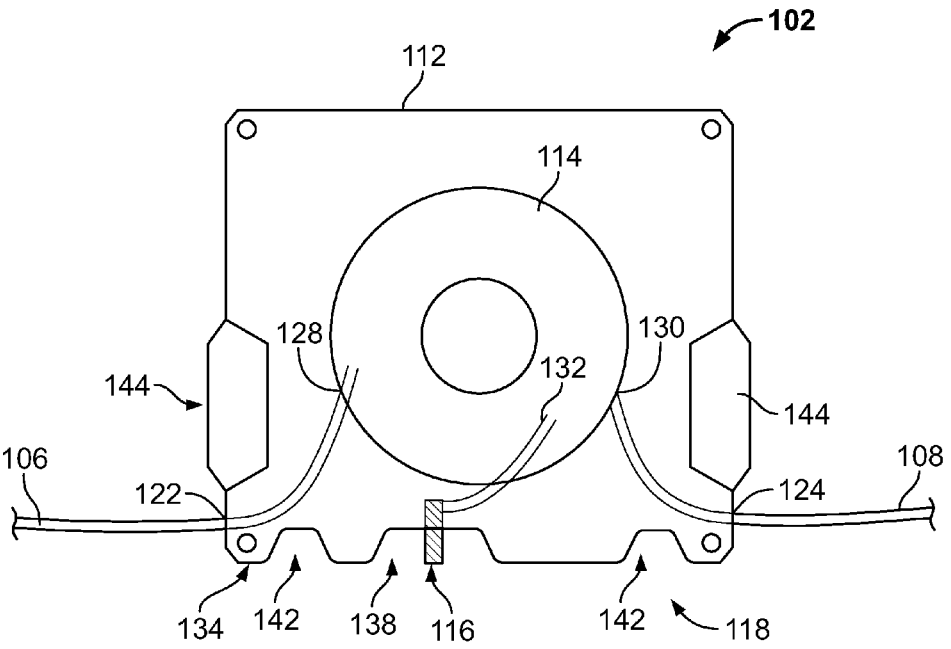
FIG. 4 is a schematic side view of the transformer module of FIG. 3.

FIGS. 3 and 4 illustrate an exemplary transformer module 102. In particular, FIG. 3 is a schematic perspective view of a transformer module 102 according to one example of the present disclosure, and FIG. 4 is a schematic side view of the transformer module 102 of FIG. 3. In addition to the primary-side wire 106 and the secondary-side wire 108, as described above, the transformer module 102 includes a housing 112, a transformer 114, a conductive tab 116, and a first coupling mechanism 118.

In general, the housing 112 defines a frame by which the transformer 114 can be attached to the base middle 104. In the embodiment shown, the housing 112 is configured to receive the transformer 114 therewithin. The housing 112 includes a primary wire hole 122 and a secondary wire hole 124, through which the primary-side wire 106 and the secondary-side wire 108 pass into the housing 112, respectively.

The transformer 114 is an electrical device that transfers energy between two circuits through electromagnetic induction. In some examples, the transformer 114 operates as a voltage transformer, which changes an AC voltage at its input to a higher or lower voltage at its output. In yet other examples, the transformer 114 is used as a signal transformer. In the depicted example, the transformer 114 is a toroidal autotransformer. However, other types of transformers can be used as the transformer 114 according to the present disclosure.

The transformer 114 has a primary terminal 128 at its input, a secondary terminal 130 at its output, and a neutral terminal 132 as a common terminal for the input and output. The primary-side wire 106 is electrically connected to the primary terminal 128 within the housing 112, and the secondary-side wire 108 is electrically connected to the secondary terminal 130 within the housing 112.

The conductive tab 116 is electrically connected to the neutral terminal 132 of the transformer 114 within the housing 112 and extends from the housing 112. For example, the conductive tab 116 protrudes from a bottom surface 134 of the housing 112. In some examples, the housing 112 includes a main groove 138 formed on the bottom surface 134 thereof, and the conductive tab 116 extends from the main groove 138, as shown in FIG. 4. As described below, the conductive tab 116 is configured to be inserted into a slot 166 (FIG. 5) of the base module 104.

The first coupling mechanism 118 operates to couple the transformer module 102 to the base module 104. In some examples, the first coupling mechanism 118 includes one or more guide grooves 142 formed on the bottom surface 134 of the housing 112. As described below, the guide grooves 142 are configured to be slidably engaged with corresponding rails 162 (FIG. 5) of the base module 104 so that the transformer module 102 is coupled to the base module 104.

In some examples, the first coupling mechanism 118 further includes a coupling button 144 configured either to couple the transformer module 102 (e.g., the first coupling mechanism 118) to the base module 104 or to release the transformer module 102 (e.g., the first coupling mechanism 118) from the base module 104. An exemplary operation of the coupling button 114 is described below in further detail with reference to FIG. 5.

Figure 5:
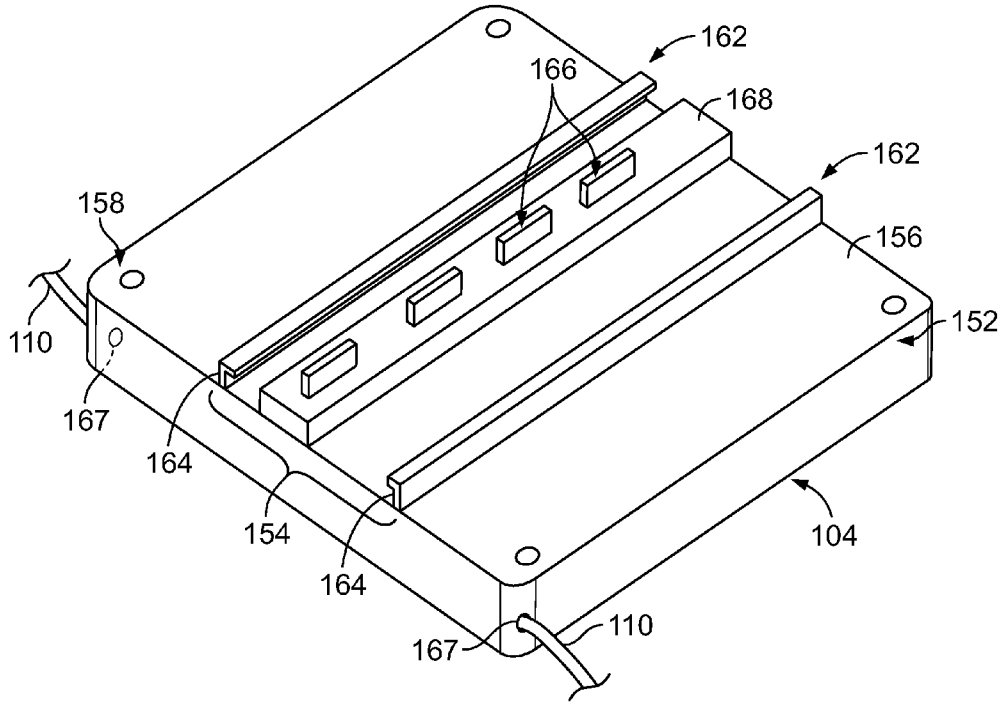
FIG. 5 is a schematic perspective view of a base module according to one example of the present disclosure.
Figure 6:
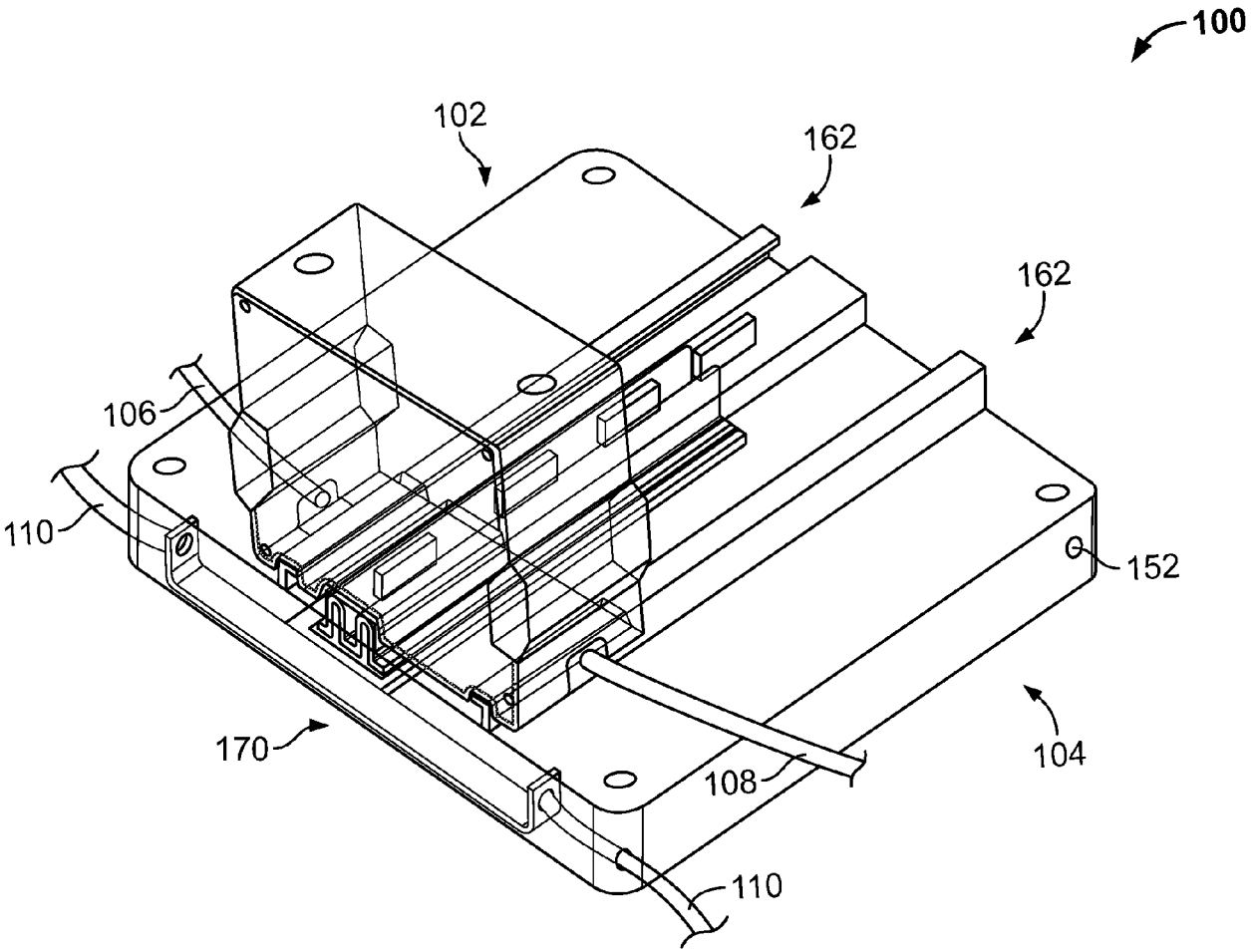
FIG. 6 is a schematic perspective view of the base module of FIG. 5 that is coupled to the transformer module.
Figure 7:
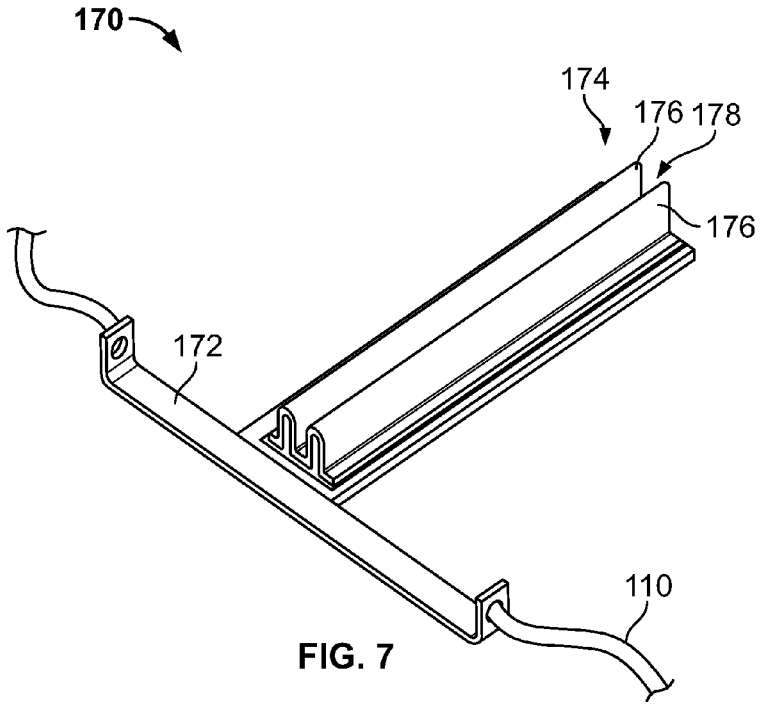
FIG. 7 is a schematic perspective view of an exemplary neutral connector.

FIGS. 5-7 illustrate an exemplary base module 104. FIG. 5 is a schematic perspective view of a base module 104 according to one example of the present disclosure. In some examples, the base module 104 includes a base enclosure 152 and a second coupling mechanism 154.

The base enclosure 152 is configured to engage the transformer module 102 on a top surface 156 of the base enclosure 152. As described below, the base enclosure 152 accommodates a neutral connector 170 (FIG. 6) therewithin. In some examples, the base enclosure 152 includes one or more mounting holes 158 configured to secure the base enclosure 152 on a predetermined location. For example, the mounting holes 158 are arranged at corners of the base enclosure 152 and configured to receive fasteners, such as screws, therein so that the base enclosure 152 is fixed onto the predetermined location with the fasteners. The base enclosure 152 further includes neutral wire holes 167 through which the neutral connection wire 110 pass.

The second coupling mechanism 154 is configured to detachably engage the first coupling mechanism 118 so that the transformer module 102 is secured onto the base module 104. In the depicted example, the second coupling mechanism 154 is arranged on the top surface 156 of the base enclosure 152.

In some examples, the second coupling mechanism 154 includes one or more rails 162 formed on the top surface 156 of the base enclosure 152. The rails 162 are configured to correspond to the guide grooves 142 of the first coupling mechanism 118 of the transformer module 102. For example, when the transformer module 102 is placed on the top surface 156 of the base enclosure 152, the rails 162 are inserted into the corresponding guide grooves 142 formed on the bottom surface 134 of the transformer module 102.

In some examples, the first coupling mechanism 118 includes a latch mechanism configured to snap-fit the first coupling mechanism 118 to the second coupling mechanism 154. The latch mechanism can be operated by the coupling button 144 of the transformer module 102. Corresponding to the latch mechanism, the rails 162 can include recesses 164 formed along the length of the rails 162. The recesses 164 are configured to be hooked by the latch mechanism of the first coupling mechanism 118 in a coupled position. In some examples, the latch mechanism is biased to be in the coupled position as a default, and released from the coupled position by operating the coupling button 144.

The second coupling mechanism 154 further includes a slot 166 configured to receive the conductive tab 116 of the transformer module 102 when the first coupling mechanism 118 is secured to the second coupling mechanism 154. The conductive tab 116 passes through the slot 166 and extends into the interior of the base enclosure 152 when the transformer module 102 is coupled to the base module 104, as shown in FIG. 6. In the depicted example, the second coupling mechanism 154 includes four slots 166 arranged in line to engage four transformer modules 102. In some examples, instead of the four slots 166 spaced apart from one another, the second coupling mechanism 154 can include one elongate slot 166 extending along the base enclosure 152 and configured to receive multiple transformer modules 102.

In some examples, the base module 104 further includes a main step 168 extending from the top surface 156 of the base enclosure 152. The main step 168 is configured to correspond to the main groove 138 of the transformer module 102 so that the main groove 138 complementarily sits onto the main step 168 when the first coupling mechanism 118 is engaged onto the second coupling mechanism 154.

FIG. 6 is a schematic perspective view of the base module 104 of FIG. 5 that is coupled to the transformer module 102. The base module 104 further includes a neutral connector 170.

The neutral connector 170 is accommodated within the base enclosure 152 and configured to be electrically connected to the power line neutral connection 18 through the neutral wire 110. As described below in further detail, the conductive tab 116 of the transformer module 102 is electrically connected to the neutral connector 170 when the first coupling mechanism 118 is engaged with the second coupling mechanism 154.

FIG. 7 is a schematic perspective view of an exemplary neutral connector 170. In some examples, the neutral connector 170 includes a connection base 172 and a conductive clip 174. The neutral connector 170 is arranged within the base enclosure 152.

The connection base 172 is configured to be electrically connected to the neutral connection wire 110. The connection base 172 is also configured to support the conductive clip 174 and electrically connected to the conductive clip 174.

The conductive clip 174 is arranged underneath the slot 166 within the base enclosure 152. Where there are multiple slots 166 arranged in line, the conductive clip 174 is configured to extend below the slots 166. Similarly, where there is an elongate slot 166, the conductive clip 174 is configured to extend below the elongate slot 166. The conductive clip 174 includes a pair of arms 176 arranged in parallel, and a hollow 178 defined by the pair of arms 176. When the transformer module 102 is coupled onto the base module 104, the conductive tab 116 passes through the slot 166 and is inserted into the hollow 178 between the arms 176 such that the conductive tab 116 is electrically connected to the arms 176. As such, the conductive tab 116 is electrically connected to the connection base 172 and the power line neutral connection 18 through the neutral connection wire 110.

Where the conductive clip 174 is arranged below multiple slots 166 or an elongate slot 166, the conductive clip 174 operates as a common connection point for the conductive tabs 116 of multiple transformer modules 102 coupled to the base module 104.

Figure 8:
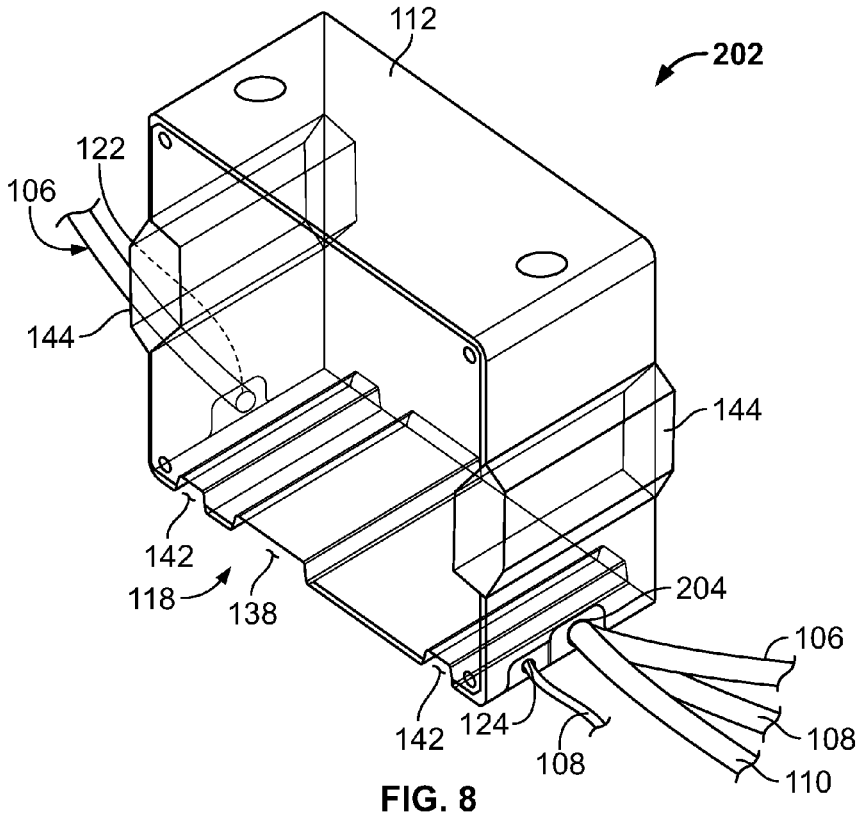
FIG. 8 is a schematic perspective view of a transformer module according to another example of the present disclosure.
Figure 9:
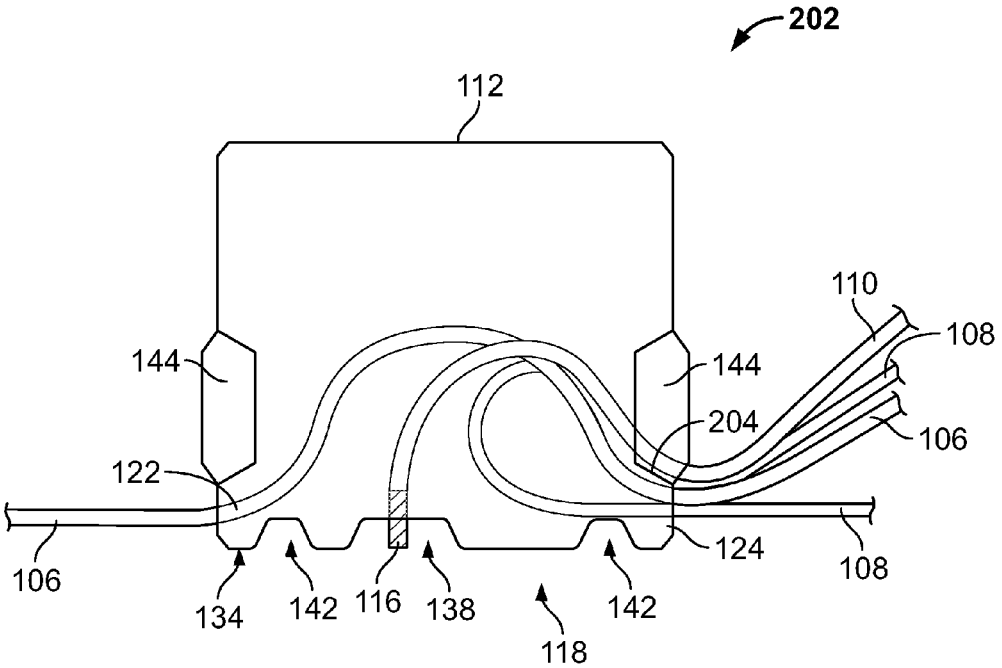
FIG. 9 is a side cross-sectional view of the transformer module of FIG. 8.

FIGS. 8 and 9 illustrate another exemplary transformer module 202. In particular, FIG. 8 is a schematic perspective view of a transformer module 202 according to another example of the present disclosure, and FIG. 9 is a side cross-sectional view of the transformer module 202 of FIG. 8. As many of the concepts and features are similar to the transformer module 102, the description for the transformer module 102 is hereby incorporated by reference for the transformer module 202. Where like or similar features or elements are shown, the same reference numbers will be used where possible. The following description will be limited primarily to the differences between the transformer module 102 and the transformer module 202.

In this example, a transformer is not accommodated within the housing 112. For example, in some cases, the transformer system 100 may require a transformer having a lower impedance and/or higher burden rating, which may not be small enough to be mounted within the housing 112. Accordingly, such a transformer is placed apart from the assembly of the transformer housing 112 and the base module 104, or at least external to a housing frame of the housing. However, the outside transformer still needs to be electrically connected to the base module 104. The transformer module 202 operates to electrically connect the outside transformer to the base module 104 in the same manner as the transformer module 102.

Similarly to the transformer 102, the transformer module 202 includes the primary-side wire 106, the secondary-side wire 108, and the neutral connection wire 110. In this example, the primary-side wire 106 is electrically connected to a primary terminal (input terminal) of the outside transformer, and the secondary-side wire 108 is electrically connected to a secondary terminal (output terminal) of the outside transformer. The neutral connection wire 110 is electrically connected to a neutral terminal of the outside transformer.

The transformer module 202 includes a wire input hole 204 configured to receive all the wires 106, 108 and 110 that are electrically connected to the outside transformer. The primary-side wire 106 is then routed out of the housing 112 through the primary wire hole 122 to be electrically connected to the power source. The secondary-side wire 108 is then routed out of the housing 112 through the secondary wire hole 124 to be electrically connected to the load. The neutral connection wire 110 is electrically connected to the conductive tap 116, which is configured to be electrically connected to the neutral connector 170, as described above. As such, the transformer module 202 operates the same as the transformer module 102 except that the transformer is not incorporated within the housing 112.

Figure 10:
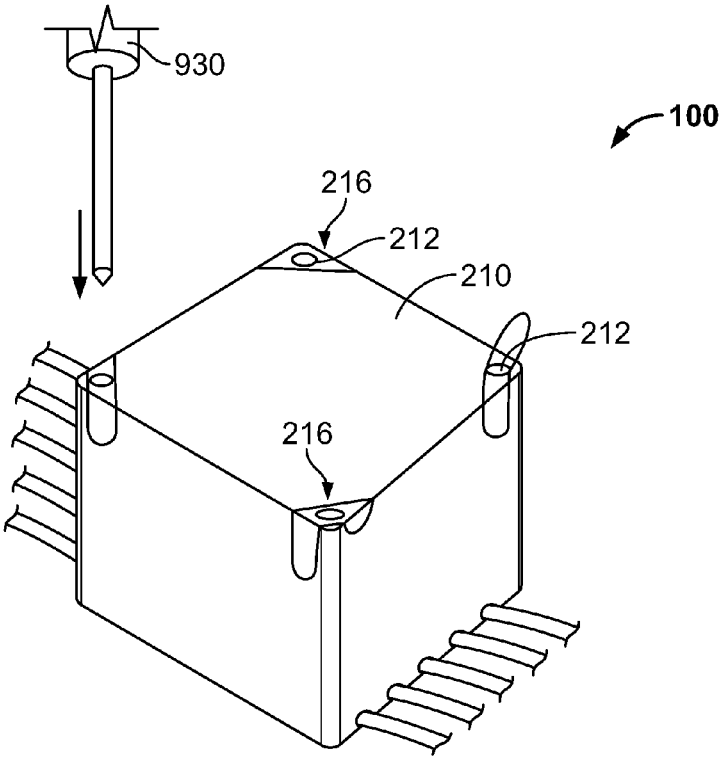
FIG. 10 is a schematic perspective view of the transformer system with a system cover according to one example of the present disclosure.
Figure 11:
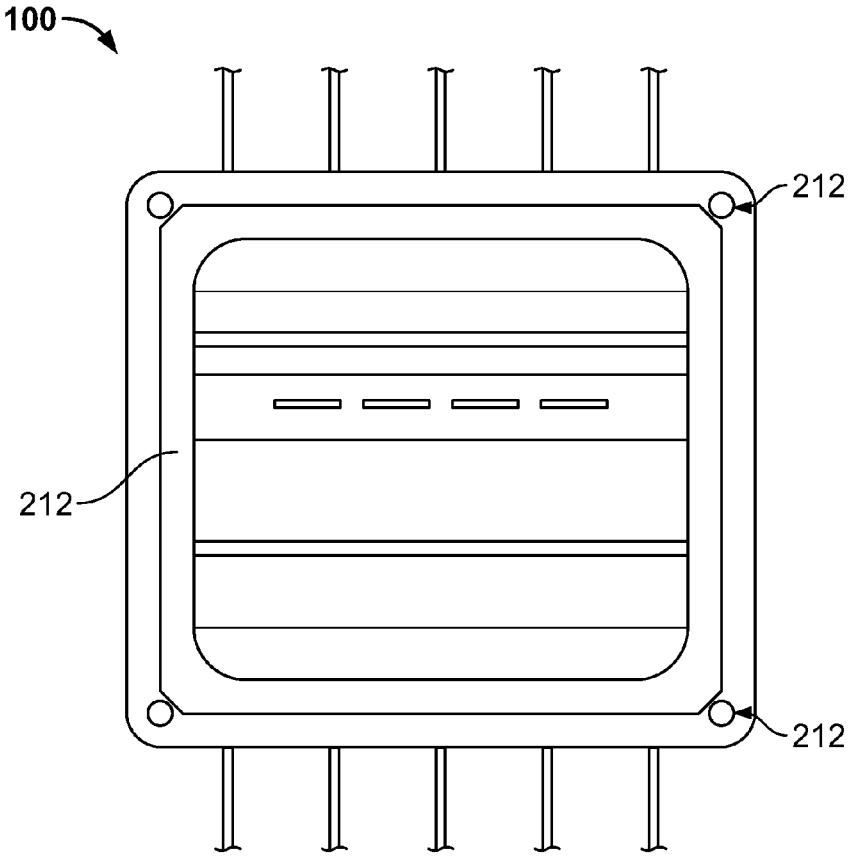
FIG. 11 is a schematic top view of the system of FIG. 10.
Figure 12:
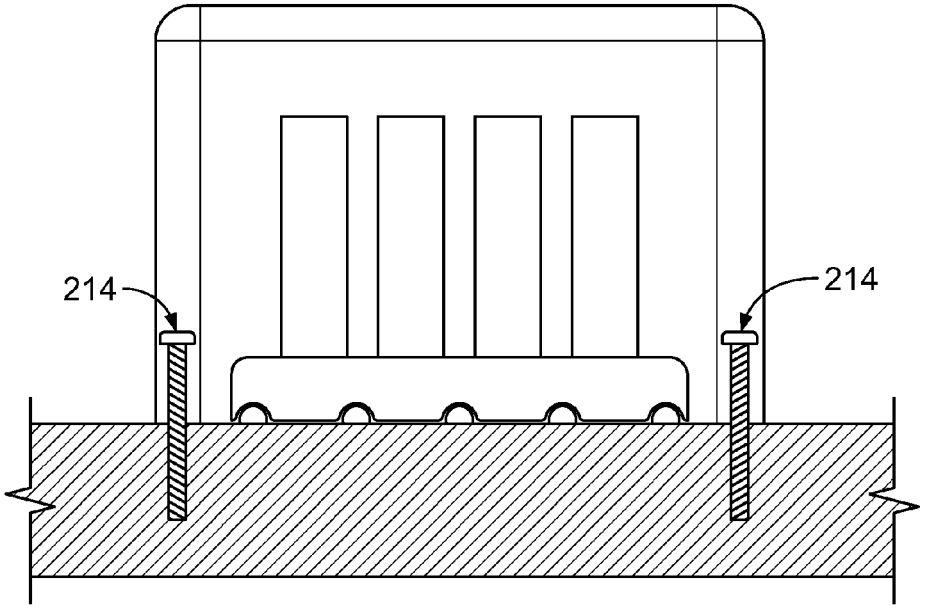
FIG. 12 is a schematic side cross-sectional view of the system of FIG. 10.

FIGS. 10-12 illustrate an exemplary system cover 210 for the transformer system 100. In particular, FIG. 10 is a schematic perspective view of the transformer system 100 with a system cover 210 according to one example of the present disclosure. FIG. 11 is a schematic top view of the system 100 of FIG. 10, and FIG. 12 is a schematic side cross-sectional view of the system 100 of FIG. 10.

The system cover 210 is configured to cover the entirety of the transformer module 102 and the base module 104 to protect the system 100. In some examples, the system cover 210 includes one or more fastening holes 212. In the depicted example, the system cover 210 includes four fastening holes 212 at the corners of the cover 210. The holes 212 extend substantially the entire height of the cover 210, as shown in FIG. 12. Fasteners 214, such as screws, are inserted into the holes 212 and fastened onto a predetermined location with a tool 930, such as a screw driver. The number and/or type of the holes 212 and the fasteners 214 can be modified for different purposes or goals.

In some examples, the system cover 210 includes seals 216 configured to be attached over the holes 212 after the cover 210 is installed with the fasteners 214. The seals 216 can operate as tamper evident tapes or seals.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

The invention claimed is:

1. A transformer system comprising:

a transformer module comprising:

a housing frame;

a transformer mounted to the housing frame and having a primary terminal, a secondary terminal, and a neutral terminal;

a primary-side wire electrically connected to the primary terminal of the transformer and extending from the housing frame to be connected to a line power;

a secondary-side wire electrically connected to the secondary terminal of the transformer and extending from the housing frame to be connected to a load; and a first coupling mechanism, and a base module comprising:

a base enclosure;

a neutral connector configured to be electrically connected to a power line neutral connection; and a second coupling mechanism arranged on the base enclosure and configured to detachably engage the first coupling mechanism of the transformer module;

wherein the neutral terminal of the transformer module and the neutral connector of the base module form a connection at a conductive tab of that is inserted into a slot at a connection location when the first coupling mechanism is engaged with the second coupling mechanism, the connection being positioned along a rail extending along the base module, the connection location being among a plurality of connections along the rail, the bottom surface of the housing being configured to receive at least a portion of the rail at the connection location.

2. The system of claim 1, further comprising a second transformer module, the second transformer module comprising:

a housing frame;

a transformer located remotely from the housing frame and having a primary terminal, a secondary terminal, and a neutral terminal;

a primary-side wire electrically connected to the primary terminal of the transformer and extending from the housing frame to be connected to a line power;

a secondary-side wire electrically connected to the secondary terminal of the transformer and extending from the housing frame to be connected to a load; and a first coupling mechanism, wherein a neutral terminal of the transformer module and the neutral connector of the base module form a second connection at a second conductive tab that is inserted into a second slot when the first coupling mechanism of the second transformer module is engaged with the second coupling mechanism at a second connection location from among the plurality of connection locations along the rail.

3. The system of claim 1, wherein the first coupling mechanism is snap-fitted to the second coupling mechanism.

4. The system of clam 3, wherein the first coupling mechanism comprises a coupling button configured selectively to couple the first coupling mechanism to the second coupling mechanism or to release the first coupling mechanism from the second coupling mechanism.

5. The system of claim 1, wherein the rail is configured to be received in the at least one groove of the transformer module when the first coupling mechanism is engaged with the second coupling mechanism.

6. The system of claim 5, wherein the at least one groove of the transformer module is slidably engaged onto the at least one rail of the base module.

7. The system of claim 5, wherein the at least one groove of the transformer module is snap-fitted to the at least one rail of the base module as the first coupling mechanism is engaged with the second coupling mechanism.

8. The system of claim 5, wherein the neutral connector comprises a conductive clip arranged underneath the slot within the base enclosure and configured to receive the conductive tab of the transformer module through the slot, the conductive clip electrically connected to the power line neutral connection.

9. A transformer module comprising:

a housing frame;

a transformer having a primary terminal, a secondary terminal, and a neutral terminal;

a primary-side wire electrically connected to the primary terminal and extending from the housing frame to be connected to a line power;

a secondary-side wire electrically connected to the secondary terminal and extending from the housing frame to be connected to a load; and a coupling mechanism configured to be detachably engaged with a base module, the base module having a neutral connector configured to be electrically connected to a power line neutral connection, wherein the transformer module, when connected to the base module, forms an electrical connection between a conductive tab and a slot, the electrical connection forming between the neutral terminal and a grounding connection of the base module at a connection location from among an array of connection locations positioned along a rail of the base module.

10. The module of claim 9, wherein the transformer is mounted within the housing frame.

11. The module of claim 9, wherein the coupling mechanism comprises at least one groove extending along a bottom surface of the housing, the at least one groove configured to receive the rail of the base module when the coupling mechanism is engaged with the base module.

12. The module of claim 11, wherein the at least one groove is snap-fitted to the at least one rail of the base module as the coupling mechanism is engaged with the base module.

13. The module of clam 12, wherein the coupling mechanism comprises a coupling button configured selectively to couple the at least one groove to the base module or to release the at least one groove from the base module.

14. The module of claim 11, wherein the at least one groove is slidably engaged onto the at least one rail of the base module.

* * * * *